US012426622B2

(12) United States Patent
Van Den Berg

(10) Patent No.: US 12,426,622 B2
(45) Date of Patent: Sep. 30, 2025

(54) CIGARETTE TUBE, PIANO FOR A CIGARETTE TUBE, METHOD FOR FORMING A CIGARETTE TUBE, AND PACKAGING FOR MULTIPLE CIGARETTE TUBES

(71) Applicant: Miquel y Costas & Miquel, S.A., Barcelona (ES)

(72) Inventor: Marinus Van Den Berg, Oud-Beijerland (NL)

(73) Assignee: Miquel y Costas & Miquel, S.A., Barcelona (ES)

( * ) Notice: Subject to any disclaimer, the term of this patent is extended or adjusted under 35 U.S.C. 154(b) by 323 days.

(21) Appl. No.: 17/419,271

(22) PCT Filed: Dec. 20, 2019

(86) PCT No.: PCT/NL2019/050870
§ 371 (c)(1),
(2) Date: Jun. 28, 2021

(87) PCT Pub. No.: WO2020/139085
PCT Pub. Date: Jul. 2, 2020

(65) Prior Publication Data

US 2022/0061378 A1 Mar. 3, 2022

(30) Foreign Application Priority Data

Dec. 28, 2018 (NL) ..... 2022321
Aug. 20, 2019 (NL) ..... 2023670

(51) Int. Cl.
*A24D 1/02* (2006.01)
*A24C 5/46* (2006.01)

(52) U.S. Cl.
CPC ..... *A24D 1/022* (2013.01); *A24C 5/46* (2013.01); *A24D 1/025* (2013.01)

(58) Field of Classification Search
CPC ..... A24D 1/022; A24D 1/025; A24C 5/46
(Continued)

(56) References Cited

U.S. PATENT DOCUMENTS 5,404,890 A * 4/1995 Gentry et al. ..... A24D 3/00 131/342
8,944,073 B1 * 2/2015 Sinclair, Jr. ..... A24C 5/35 131/283

(Continued)

FOREIGN PATENT DOCUMENTS

EP 0 615 700 A1 9/1994
WO 99/56569 A1 11/1999

OTHER PUBLICATIONS

International Search Report for PCT/NL2019/050870, Jul. 2, 2020, 6 pages.

*Primary Examiner* — Michael H. Wilson
*Assistant Examiner* — Ronnie Kirby Jordan
(74) *Attorney, Agent, or Firm* — Danielson Legal LLC

(57) ABSTRACT

The invention relates to a cigarette tube (1) comprising a shell (2) with an inhalation end (8), a lighting end (9) and an internal channel (3) with a center line (Q), wherein the shell (2) comprises a cigarette paper (5) around the center line (Q), wherein the cigarette paper (5) has meeting overlapping edges that form a seam (4) of the shell (2), wherein the seam (4) has in the direction of the center line (Q) between its opposite ends a helicoid curvature around the center line (Q).

15 Claims, 11 Drawing Sheets

(58) Field of Classification Search
USPC ..... 131/365
See application file for complete search history.

(56) References Cited

U.S. PATENT DOCUMENTS

| | | | | |
|---|---|---|---|---|
| 9,961,935 | B1 * | 5/2018 | Sinclair, Jr. ..... | A24D 1/022 |
| 2013/0306082 | A1 * | 11/2013 | Sherwood et al. .... | A24D 1/025<br>131/280 |
| 2017/0360082 | A1 * | 12/2017 | Slama et al. ..... | A24D 1/022 |

* cited by examiner

CIGARETTE TUBE, PIANO FOR A CIGARETTE TUBE, METHOD FOR FORMING A CIGARETTE TUBE, AND PACKAGING FOR MULTIPLE CIGARETTE TUBES

CROSS REFERENCE TO RELATED APPLICATIONS

The present application is a national phase application of and claims the benefit of and priority to International (PCT) Patent Appl. No. PCT/NL2019/050870, filed internationally on Dec. 20, 2019, which itself claims priority to Netherlands Patent Appl. No. 2022321, filed Dec. 28, 2018, and Netherlands Patent Appl. No. 2023670, filed Aug. 20, 2019, the entire disclosure of each of which is hereby incorporated by reference as if set forth in their entirety herein.

BACKGROUND

The invention relates to a cigarette tube, a piano for a cigarette tube, a method for forming a cigarette tube, and a packaging for multiple cigarette tubes.

Cigarettes generally comprise a paper tube filled with tobacco. The tube may be provided with a tip or filter at one end thereof to filter the smoke before it is inhaled. Cigarettes can be pre-fabricated or the user may make his own cigarettes. An advantage of self-made cigarettes is that the user is able to determine the content of the cigarette. The tobacco may be supplemented with or replaced by for instance herbs or other additives.

A method to make cigarettes is to fill a pre fabricated cigarette tube. This can be done by hand or by using a machine. Pre-fabricated tubes may be cylindrical or cone shaped.

SUMMARY OF THE INVENTION

The paper of the cigarette tube has influence on the smoldering, the temperature and thereby on the taste of the cigarette. In general it is desirable to use as little paper as possible in the cigarette tubes, especially when the cigarette comprises herbs or other additives. Therefore most cigarette tubes comprise very thin and light paper.

A disadvantage of such a cigarette tubes is that it is fragile. The cigarette tube easily gets kinked or wrinkled, especially during filling of the cigarette tube.

It is an object of the present invention to provide a cigarette tube that is more resistive to damage.

According to a first aspect, the invention provides a cigarette tube comprising a shell with an inhalation end, a lighting end and an internal channel with a center line, wherein the shell comprises a cigarette paper around the center line, wherein the cigarette paper has meeting overlapping edges that form a seam of the shell, wherein the seam has in the direction of the center line between its opposite ends a helicoid curvature around the center line.

The seam is more rigid than the cigarette paper of the cigarette tube as it comprises two layers of cigarette paper. The adhesive between the layers also ads rigidity. As the helicoid seam at least partly encircles the cigarette tube it provides axial and radial strength to the cigarette tube and is therefore more resistive to damage than cigarette tubes having a straight seam. The more rigid cigarette tube also allows for the use of less glue.

Cigarette tubes having a straight seam tend to bent in the axial direction as a result of the adhesive that dries after applying it. As a helicoid seam extends more evenly around the surface of the cigarette tube, the cigarette tube is not influenced by drying adhesive. As a result the cigarette tubes according to the invention are more radially straight.

In an embodiment the seam has between its opposite ends a helicoid curvature of at least 90 degrees around the center line.

In an embodiment the seam has between its opposite ends a helicoid curvature of at least 180 degrees around the center line.

In an embodiment the seam extends in the direction of the center line between the inhalation end and the lighting end.

In an embodiment the shell conically widens from the inhalation end to the lighting end. This shape allows for easy filling of the cigarette tube with tobacco.

In an embodiment the shell is straight cylindrical from the inhalation end to the lighting end. This shape allows for efficient storing of the cigarette tubes in a cigarette box.

In an embodiment the overlapping edges overlap each other over a distance transverse to the overlapping edges that is constant over the length of the seam. In this way the seam and therewith the cigarette tube has a uniform strength along its length.

In an embodiment the overlapping edges overlap each other over a distance transverse to the overlapping edges of maximal 3 millimeters. The vast majority of the shell comprises only one layer of cigarette paper, only the seam comprises two layers of cigarette paper. Little excess paper and little adhesive is used in the cigarette tubes so that the influence on the taste of the cigarette is reduced to a minimum.

In an embodiment the overlapping edges overlap each other over a distance transverse to the overlapping edges of maximal 2 millimeters thereby using even less excess paper and adhesive in the cigarette tubes.

In an embodiment the overlapping edges are attached to each other with an adhesive thereby additionally strengthening the cigarette tube.

In an embodiment the cigarette tube comprises at the inhalation end a filter inside the shell to filter out particles from the smoke of the cigarette before inhaling.

In an embodiment the cigarette paper has a thickness between 10 and 40 micrometers to use little paper material.

In a preferred embodiment the cigarette paper has a thickness between 18 and 30 micrometers.

In an embodiment the cigarette paper has a specific weight between 5 and 30 grams per square meter.

In a preferred embodiment the cigarette paper has a specific weight between 8.5 and 25 grams per square meter.

In an embodiment the cigarette paper comprises flax or hemp or sisal or rice straw or esparto or combinations thereof.

According to a second aspect, the invention provides a cigarette tube comprising a shell with an inhalation end, a lighting end and an internal channel with a center line, wherein the shell comprises a cigarette paper around the center line, wherein the cigarette paper has meeting overlapping edges that form a seam of the shell, wherein the shell conically widens from the inhalation end to the lighting end, wherein the overlapping edges overlap each other over a distance transverse to the overlapping edges that is constant over the length of the seam, wherein the distance transverse to the overlapping edges is maximal 3 millimeters, preferably maximal 2 millimeters.

The conical shape allows for easy filling of the cigarette tube with tobacco and/or herbs or other additives. The small overlapping distance of the edges means that little excess paper and little adhesive is used in the cigarette tubes so that the influence on the taste of the cigarette is reduced to a minimum.

According to a third aspect, the invention provides a piano of cigarette paper for forming a cigarette tube, wherein the cigarette tube comprises a shell with an inhalation end, a lighting end and an internal channel with a center line, wherein the shell comprises the cigarette paper around the center line, wherein the piano of cigarette paper has a circumference that is bounded by a first edge and a second edge that extend opposite to and spaced apart from each other to bound the inhalation end and the lighting end of the shell, and a third edge and a fourth edge that extend opposite to and spaced apart from each other between the first edge and the second edge to come in overlap with each other to form a seam of the shell, wherein the second edge is offset with respect to the first edge in the elongate direction of the first edge or second edge.

When constructing a cigarette tube from the piano the third edge is rolled towards the fourth edge to come in overlap with each other. The shape of the piano with first and second edges that are offset with respect to each other ensures that the rolled cigarette tube comprises a helicoid seam.

In an embodiment a first corner between the third edge and the second edge is offset with respect to a second corner between the third edge and the first edge over a distance that is at least ½ of the length of the second edge. A piano with this offset of the first and second edges ensures that the rolled cigarette tube comprises a helicoid seam of at least 180 degrees around the center line.

In an embodiment the first corner is offset with respect to the second corner over a distance that is at least once the length of the second edge. A piano with this offset of the first and second edges ensures that the rolled cigarette tube comprises a helicoid seam of at least 360 degrees around the center line.

In an embodiment the third edge and the fourth edge are curved in the same direction as from the first edge to the second edge, having the same curvature or radius. When rolling a cigarette tube from a piano having his shape it ensures a cigarette tube having a helicoid seam that spirals uniformly around the center line, when the cigarette tube has a conical shape.

In an embodiment the first edge and the second edge have a radius with respect to a notional first center point outside the piano, wherein the third edge and the fourth edge have the same radius with respect to a notional second center point and notional third center point outside the piano, wherein the second center point and the third center point are located on the same notional circle having the first center point. When rolling a cigarette tube from a piano having his shape it ensures a conical cigarette tube having a helicoid seam.

In an embodiment the piano comprises a handling lip that projects from the third edge or the fourth edge. The handling lip at one edge provides enhanced initial engagement with the opposite edge when rolling a cigarette tube therefrom. The handling lip furthermore is advantageous when aligning the opposite ends of the first edge and/or the second edge with each other when rolling a cigarette tube from the piano.

In an embodiment the cigarette paper has a thickness between 10 and 40 micrometers.

In a preferred embodiment the cigarette paper has a thickness between 18 and 30 micrometers.

In an embodiment the cigarette paper has a specific weight between 5 and 30 grams per square meter.

In a preferred embodiment the cigarette paper has a specific weight between 8.5 and 25 grams per square meter.

In an embodiment the cigarette paper comprises flax or hemp or sisal or rice straw or esparto or combinations thereof.

According to a fourth aspect, the invention provides a piano of cigarette paper for forming a cigarette tube, wherein the cigarette tube comprises a shell with an inhalation end, a lighting end and an internal channel with a center line, wherein the shell comprises the cigarette paper around the center line, wherein the piano of cigarette paper has a circumference that is bounded by a first edge and a second edge that extend opposite to and spaced apart from each other to bound the inhalation end and the lighting end of the shell, and a third edge and a fourth edge that extend opposite to and spaced apart from each other between the first edge and the second edge to come in overlap with each other to form a seam of the shell, wherein the piano comprises a handling lip that projects from the third edge or the fourth edge.

The handling lip at one edge provides enhanced initial engagement with the opposite edge when rolling a cigarette tube therefrom. The handling lip furthermore is advantageous when aligning the opposite ends of the first edge and/or the second edge with each other when rolling a cigarette tube from the piano.

According to a fifth aspect, the invention provides a method for producing a cigarette tube from a piano of cigarette paper, wherein the cigarette tube comprises a shell with an inhalation end, a lighting end and an internal channel with a center line, wherein the shell comprises the cigarette paper around the center line, wherein the piano of the cigarette paper has a circumference that is bounded by a first edge and a second edge that extend opposite to and spaced apart from each other to bound the inhalation end and the lighting end of the shell, and a third edge and a fourth edge that extend opposite to and spaced apart from each other between the first edge and second edge to come in overlap with each other to form a seam of the shell, wherein the second edge is offset with respect to the first edge in the elongate direction of the first edge or second edge, wherein the method comprises the step of rolling the piano around the center line starting from a corner of the third edge or fourth edge with the first edge or second edge, and bringing the third edge and fourth edge in overlap with each other to form a seam of the shell, wherein the seam obtains in the direction of the center line between its opposite ends a helicoid curvature around the center line.

In an embodiment an adhesive is applied along the third edge or fourth edge to bound the overlapping edges together.

In an embodiment the piano is rolled around a conically widening rolling mandrel. Using a conical rolling mandrel makes rolling a conical cigarette tube more easy. It also allows to use a minimal overlap of the edges.

In an embodiment the piano is rolled around a straight cylindrical rolling mandrel. Using a cylindrical rolling mandrel makes rolling a cylindrical cigarette tube more easy. It also allows to use a minimal overlap of the edges.

In an embodiment the third edge and the fourth edge are brought in overlap with each other over a distance transverse to the overlapping edges that is constant over the length of the seam. In this way the resulting cigarette tube has a uniform strength along its length.

In an embodiment the piano comprises a handling lip that projects from the third edge or the fourth edge, wherein the method comprises the step of removing a section of the shell of the rolled cigarette tube along the inhalation end or the lighting end thereof, wherein the removed section of the shell comprises the handling lip.

In an embodiment the cigarette paper has a thickness between 10 and 40 micrometers.

In a preferred embodiment the cigarette paper has a thickness between 18 and 30 micrometers.

In an embodiment the cigarette paper has a specific weight between 5 and 30 grams per square meter.

In a preferred embodiment the cigarette paper has a specific weight between 8.5 and 25 grams per square meter.

In an embodiment the cigarette paper comprises flax or hemp or sisal or rice straw or esparto or combinations thereof.

According to a sixth aspect, the invention provides an assembly of multiple of the cigarette tubes according to the invention and a packaging containing these cigarette tubes, wherein the packaging comprises a shell with a bottom end, a top end and an internal channel with a center line in which the cigarette tubes are contained, wherein the shell of the packaging comprises a sheet of packaging carton or packaging paper around the center line of the packaging, wherein the packaging carton or packaging paper has meeting overlapping edges that form a seam of the shell, wherein the seam has in the direction of the center line of the packaging between its opposite ends a helicoid curvature around this center line.

In an embodiment the seam of the packaging has between its opposite ends a helicoid curvature of at least 180 degrees around the center line of the packaging.

In an embodiment the seam of the packaging has between its opposite ends a helicoid curvature of at least 360 degrees around the center line of the packaging.

In an embodiment the seam of the packaging extends in the direction of the center line of the packaging between the bottom end and the top end.

In an embodiment the shell of the packaging conically widens from the bottom end to the top end.

In an embodiment the shell of the packaging is straight cylindrical from the bottom end to the top end.

In an embodiment the overlapping edges of the shell of the packaging overlap each other over a distance transverse to the overlapping edges that is constant over the length of the seam.

In an embodiment the overlapping edges of the shell of the packaging overlap each other over a distance transverse to the overlapping edges of 5-15 millimeters.

In an embodiment the overlapping edges of the shell of the packaging are attached to each other with an adhesive.

In an embodiment the packaging comprises at the bottom end a bottom closure that extends at least partially inside the shell of the packaging.

In an embodiment the packaging comprises at the top end a top closure that extends at least partially inside the shell of the packaging.

In an embodiment the packaging carton or packaging paper has a thickness between 50 and 600 micrometers.

In an embodiment the packaging carton or packaging paper has a specific weight between 50 and 500 grams per square meter.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of exemplary embodiments shown in the attached drawings, in which.

DETAILED DESCRIPTION OF THE INVENTION

Figure 1:
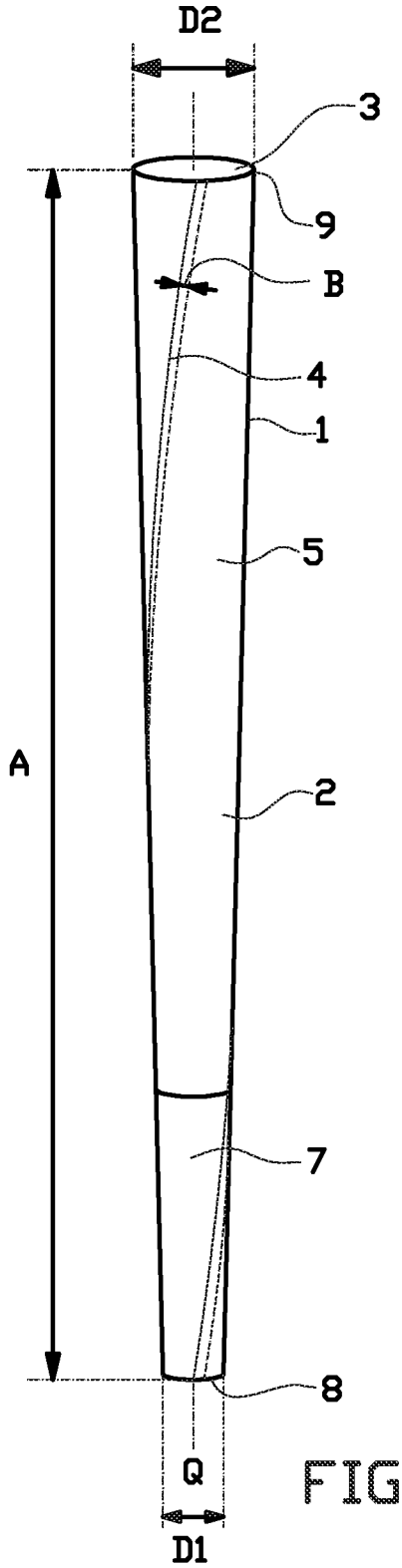
FIG. 1 shows a conical cigarette tube with a spiraled seam according to a first embodiment of the invention.

FIG. 1 shows a cigarette tube 1 according to a first embodiment of the invention. The cigarette tube 1 comprises a conical shell 2 that defines an internal channel 3 with a center line Q. The shell 2 comprises a single cigarette paper 5 around the center line Q. The edges of the cigarette paper 5 only overlap along the length of the cigarette tube 1, that is, the shell 2 mostly comprises only one layer of cigarette paper 5 around the center line Q. The overlapping edges of the cigarette paper 5 form a spiraled seam 4 of the shell 2 having a helicoid curvature around the center line Q. Along the seam 4 the cigarette paper 5 is attached onto itself by a not shown line of an adhesive, more specifically a glue. In this example the cigarette tube 1 furthermore comprises a filter or tip 7 inside the shell 2.

Figure 2:
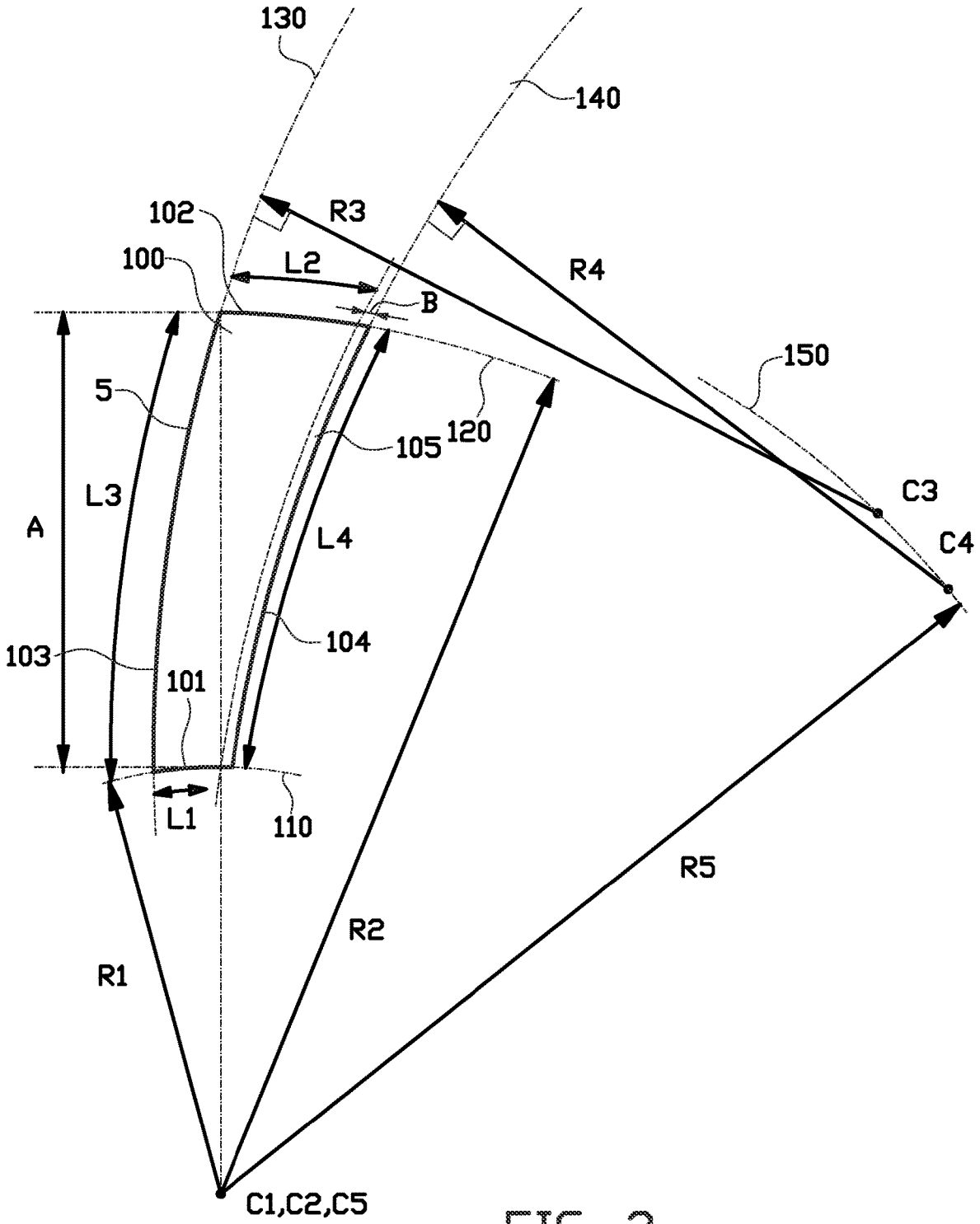
FIG. 2 shows a piano of the cigarette tube according to FIG. 1.

FIG. 2 shows a piano 100 of the cigarette paper 5 as shown in FIG. 1. The piano 100 can be used to construct or roll the cigarette tube 1 according to the first embodiment of the invention as shown in FIG. 1.

Figure 3C:
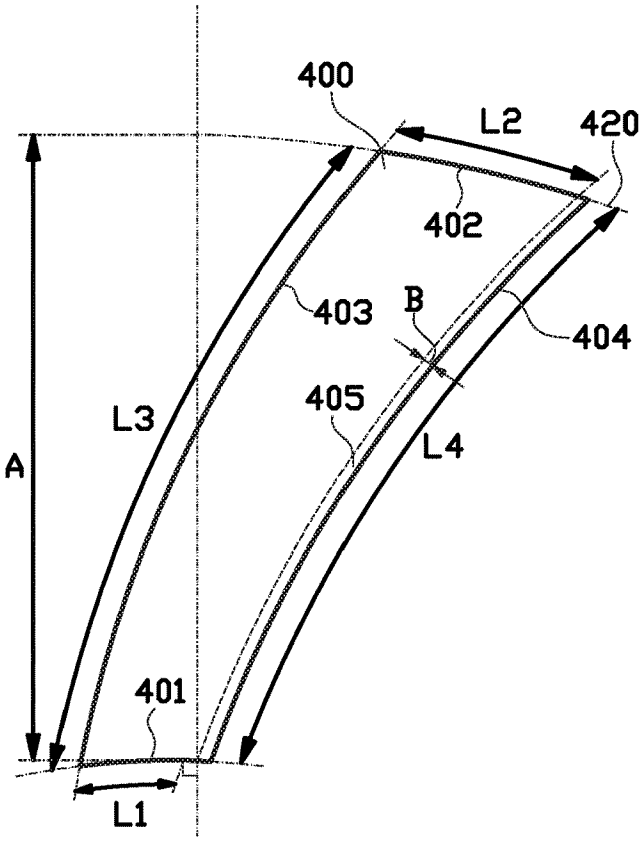
FIGS. 3A, 3B and 3C show alternative pianos of a cigarette tube according to the first embodiment of the invention respectively, having different spiraled seams.
Figure 3B:
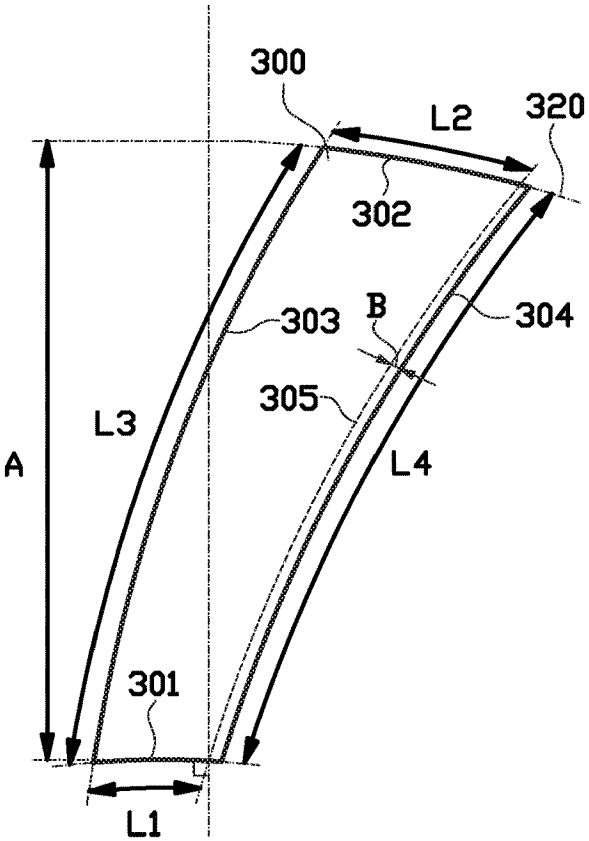
Figure 3A:
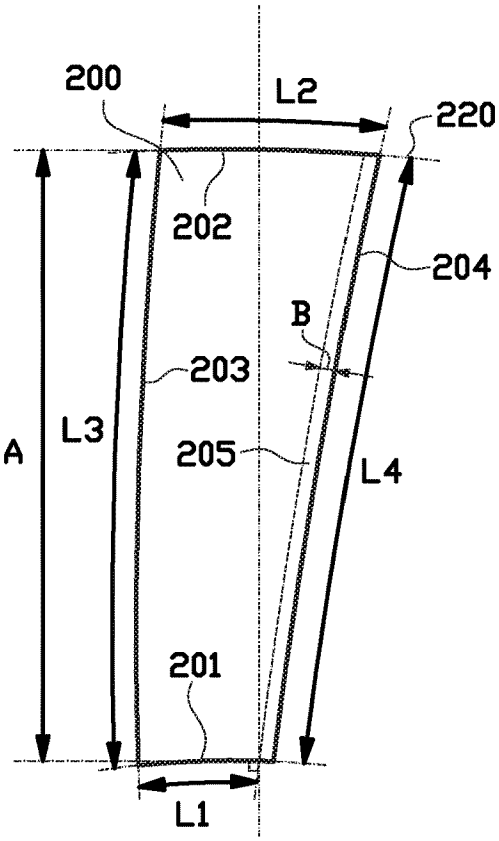

FIGS. 3A, 3B and 3C show alternative pianos 200, 300, 400 that can be used to roll cigarette tubes that are similar to the cigarette tube 1 of FIG. 1 but that have a different helicoid curvature.

Figure 4:
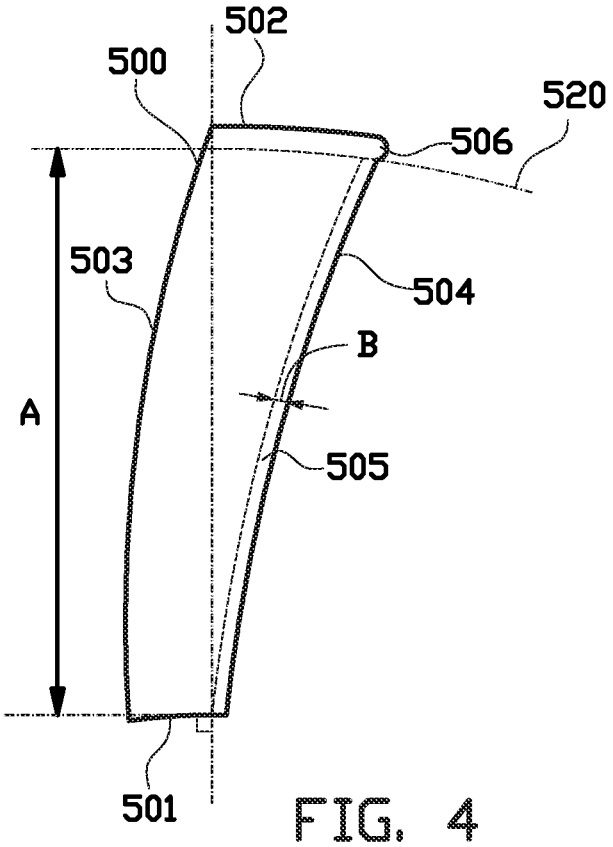
FIG. 4 shows a piano for the cigarette tube according to the first embodiment of the invention, having a handling lip.

FIG. 4 shows an alternative piano 500 that can be used to roll cigarette tubes that are similar to the cigarette tube 1 and that has an additional handling lip 506 that can be used for manually rolling a cigarette tube from the piano 500.

Figure 6:
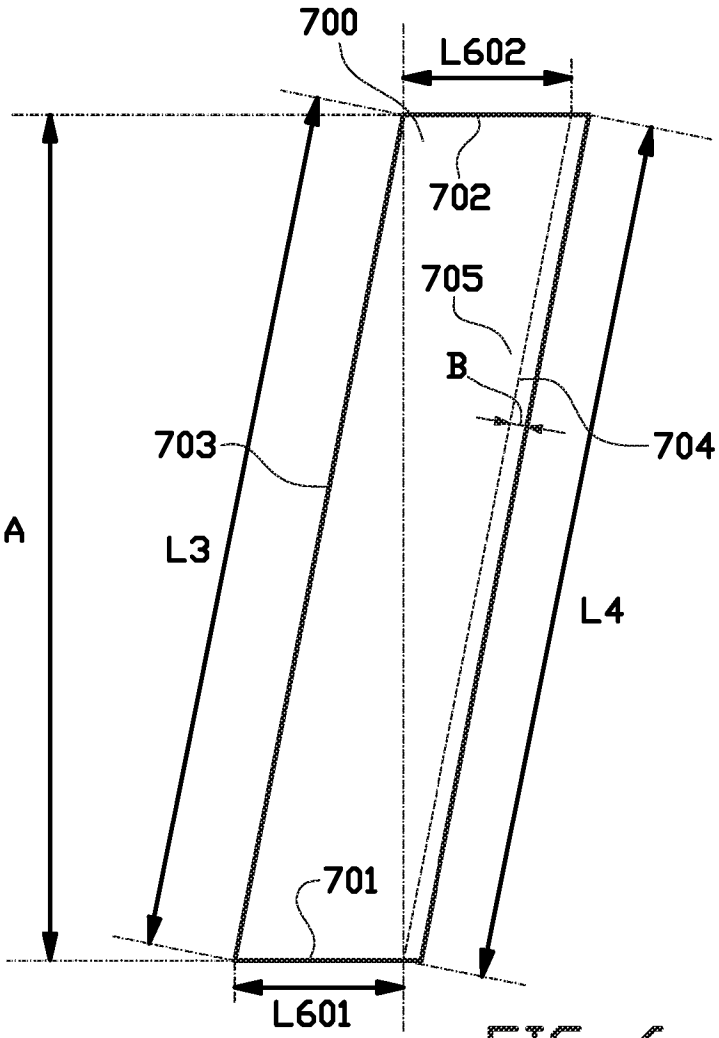
FIG. 6 shows a piano of the cigarette tube according to FIG. 5.
Figure 5:
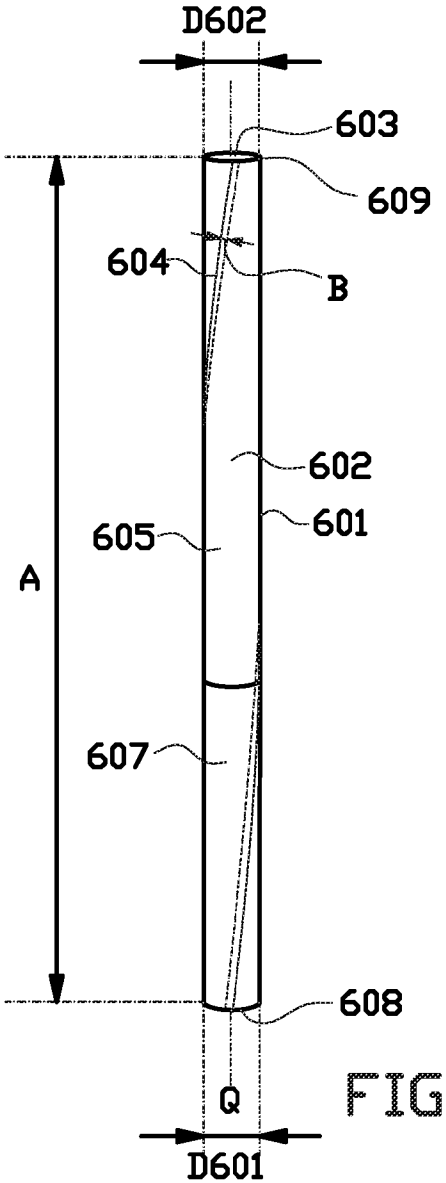
FIG. 5 shows a cylindrical cigarette tube with a spiraled seam according to a second embodiment of the invention.

FIGS. 5 and 6 respectively show an alternative cigarette tube 601 according to a second embodiment of the invention and a piano 700 thereof. The cigarette tube 601 has a straight cylindrical shape with a center line Q instead of a conical shape and the edges of the piano 700 are straight instead of curved.

Figure 7:
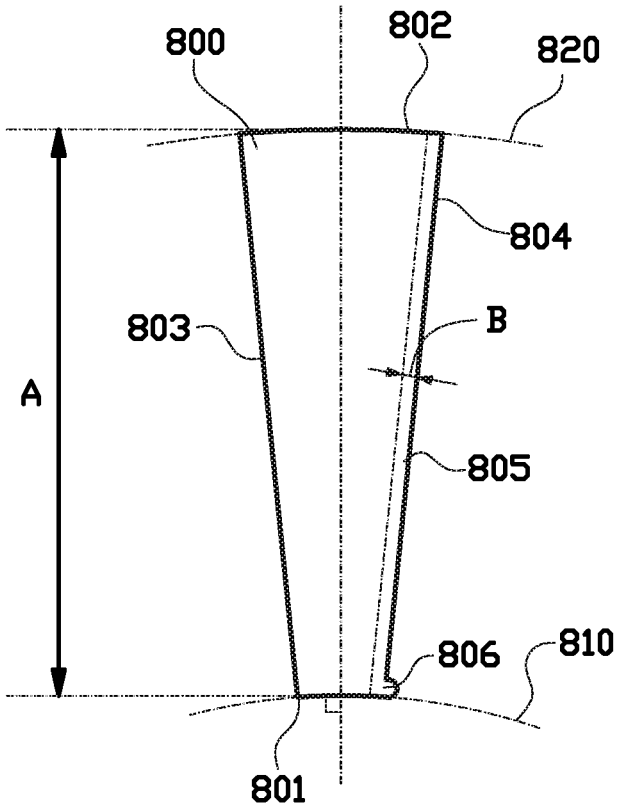
FIG. 7 shows a piano of a cigarette tube according to a third embodiment of the invention, having straight longitudinal edges and a handling lip.

FIG. 7 shows a piano 800 that can be used to roll a not shown conical cigarette tube according to a third embodiment of the invention that has a seam that is straight in the direction of the center line of the cigarette tube. The piano 800 has a handling lip 806 that can be used for manually rolling the cigarette tube from the piano 800.

The cigarette tube 1 according to the first embodiment as shown in FIG. 1 has an elongated frustoconical shape and comprises an inhalation end 8 having a first width or diameter DI, and a lighting end 9 having a second width or diameter D2 which is larger than the first diameter DI. The cigarette tube 1 has a tube length A along the center line Q between the inhalation end 8 and the lighting end 9. The seam 4 at the shell 2 has a helicoid curvature around the center line Q along the length of the cigarette tube 1 between the inhalation end 8 and the lighting end 9. In this example the seam 4 helicoils 360 degrees around the center line Q over the length A of the cigarette tube 1, that is, the ends of the seam 4 are located on the same side of the cigarette tube 1 at both the inhalation end 8 and at the lighting end 9. A substantially constant overlap distance B of the cigarette paper 5 in a direction substantially transverse to the seam 4 is less than 3 millimeters, in this example it is equal to 2 millimeters or less.

The cigarette paper 5 is thin and lightweight paper and may comprise flax, hemp, sisal, rice straw, esparto or combinations thereof. The cigarette paper 5 is between 10 micrometer and 40 micrometer thick, preferably between 18 and 30 micrometer thick and has a specific weight between 5 and 30 grams per square meter, preferably between 8.5 and 25 grams per square meter.

The piano 100 of FIG. 2 has an elongated shape and has a circumference that is bound by a first edge 101 that corresponds to the inhalation end 8 of the cigarette tube 1, a second edge 102 opposite to the first edge 101 that corresponds to the lighting end 9 of the cigarette tube 1, a longitudinal third edge 103 between the first edge 101 and the second edge 102, and a longitudinal fourth edge 104 between the first edge 101 and the second edge 102 opposite to the third edge 103. The piano 100 furthermore comprises a notional overlap part 105 along the length of the fourth edge 104. The overlap part 105 corresponds to the overlap of the cigarette paper 5 along the seam 4 of the cigarette tube 1. The overlap part 105 comprises the line of adhesive along the length of the fourth edge 104. It is to be understood that the notional overlap part 105 and the adhesive may also be located in the same way along the opposite third edge 103 of the piano 100.

The second edge 102 is offset with respect to the first edge 101 in a direction transverse to the general longitudinal direction of the piano 100. The offset of the second edge 102 is related to the degree the seam 4 spirals or helicoils around the center line Q of the cigarette tube 1. The more the seam 4 helicoils around the center line Q of the cigarette tube 1, the more the second edge 102 is offset with respect to the first edge 101.

In this example the first edge 101 corresponds to a section of the circumference of a notional first circle 110 having a first center point CI and a first radius R1. The second edge 102 corresponds to a section of the circumference of a notional second circle 120 having a second center point C2 and a second radius R2. The second center point C2 coincides with the first center point C1. The circumferences of the first circle 110 and the second circle 120 are spaced apart over a distance that is equal to the tube length A.

The first edge 101 has a first length L1 between the third edge 103 and the overlap part 105 along the circumference of the first circle 110. The first length L1 is related to the first diameter D1 of the inhalation end 8 of the cigarette tube 1 according L1=n*D1.

The second edge 102 has a second length L2 between the third edge 103 and the overlap part 105 along the circumference of the second circle 120. The second length L2 is related to the second diameter D2 of the lighting end 9 of the cigarette tube 1 according L2=n*D2. The second length L2 is larger than the first length L1.

The first diameter DI, the second diameter D2 and the tube length A are related to the first radius R1 and the second radius R2 according R1=A/(D2/D1−1) and R2=A/(1−D1/D2).

In this example the seam 4 of the cigarette tube 1 that is rolled from the piano 100 helicoils 360 degrees around the center line Q of the cigarette tube 1. Therefore the second edge 102 is offset over a distance substantially equal to the second length L2 of the second edge 102 along the circumference of the second circle 120.

The third edge 103 corresponds to a section of the circumference of a notional third circle 130 having a third center point C3 and a third radius R3. The fourth edge 104 corresponds to a section of the circumference of a notional fourth circle 140 having a fourth center point C4 and a fourth radius R4 that is equal to the third radius R3. The third radius R3 and the fourth radius R4 are related to the degree the seam 4 helicoils around the center line Q of the cigarette tube 1.

The circumference of the third circle 130 and the fourth circle 140 intersect the first center point C1 and the second center point C2. Furthermore the third center point C3 and the fourth center point C4 are both located on the circumference of a notional fifth circle 150 having a fifth center point C5 and a fifth radius R5. The fifth center point C5 coincides with the first center point C1 and the second center point C2.

The third edge 103 has a third length L3 along the circumference of the third circle 130 between the first edge 101 and the second edge 102. The fourth edge 104 has a fourth length L4 along the circumference of the fourth circle 140 between the first edge 101 and the second edge 102.

FIG. 3A shows the first alternative piano 200 which is generally the same as the piano 100 of the first embodiment of the invention as described above. Reference numbers of identical parts are increased by 100, and those parts are not further described below.

In the first alternative piano 200 the second edge 202 is offset over a distance substantially equal to half of the second length L2 of the second edge 202 along the circumference of the second circle 220. When a cigarette tube is rolled from the piano 200 this results in a seam that helicoils 180 degrees around the center line Q of the cigarette tube, that is, the seam helicoils from one side of the cigarette tube at the lighting end to the opposite side of the cigarette tube at the inhalation end.

FIG. 3B shows the second alternative piano 300 which is generally the same as the piano 100 of to the first embodiment of the invention as described above. Reference numbers of identical parts are increased by 200, and those parts are not further described below.

In the second alternative piano 300 the second edge 302 is offset over a distance substantially equal to one and a half times the second length L2 of the second edge 302 along the circumference of the second circle 320. When a cigarette tube is rolled from the piano 300 this results in a seam that helicoils 540 degrees around the center line Q of the cigarette tube.

FIG. 3C shows the third alternative piano 400 which is generally the same as the piano 100 of to the first embodiment of the invention as described above. Reference numbers of identical parts are increased by 300, and those parts are not further described below.

In the third alternative piano 400 the second edge 402 is offset over a distance substantially equal to two times the second length L2 of the second edge 402 along the circumference of the second circle 420. When a cigarette tube is rolled from the piano 400 this results in a seam that helicoils 720 degrees around the center line Q of the cigarette tube.

FIG. 4 shows the fourth alternative piano 500 which is generally the same as the piano 100 of to the first embodiment of the invention as described above. Reference numbers of identical parts are increased by 500, and those parts are not further described below.

The fourth alternative piano 500 comprises a handling lip 506 at the corner between the second edge 502 and the fourth edge 504. The handling lip 506 protrudes in this example from the fourth edge 504 near the second edge 502 but may also protrude from the third edge 503 of the piano 500 and/or near the first edge 501. When rolling a cigarette tube, more specifically when manually rolling a cigarette tube, the handling lip 506 provides additional overlap along the third edge 503 and the fourth edge 504 near one end of the cigarette tube. The additional overlap provides enhanced initial engagement of the third edge 503 with the fourth edge 504 when rolling the cigarette tube. The handling lip 506 furthermore is advantageous when aligning the piano 500 when rolling a cigarette tube therefrom. Especially when rolling a cigarette tube having a very narrow overlap distance at the seam it is impracticable to roll such a cigarette tube from a piano 500 without the handling lip 506. It is to be understood that any of the pianos for a cigarette tube may be provided with a handling lip 506 as described above.

To roll a cigarette tube from the piano 500 it is rolled around the center line Q, starting from the corner where the handling lip 506 is located, in this example the corner between the second edge 502 and the fourth edge 504. The handling lip 506 and the fourth 504 edge are brought in overlap with the third edge 503 while aligning the opposite ends of the second edge 502 with each other. The handling lip 506 engages the third edge 503 so that, when rolling further, the third edge 503 and fourth edge 504 are brought in overlap with each other to form the seam of the cigarette tube. The third edge 503 and the fourth edge 504 are attached to each other by applying adhesive to the overlap part 505. A small section of the shell 2 along the end thereof, that comprises the handling lip 506, may be removed from the cigarette tube in order to obtain the cigarette tube with the length A that does not comprise the handling lip 506. The section of the shell along the end thereof may be removed by axially cutting the cigarette tube.

It is to be understood that when the handling lip 506 is located at a different corner of the piano 500 the rolling method of the cigarette tube as described above is started from the corresponding corner.

FIG. 5 shows a cigarette tube 601 according to the second embodiment of the invention. The cigarette tube 601 is generally the same as the cigarette tube 601 according to the first embodiment of the invention as described above. Reference numbers of identical parts are increased by 600, and those parts are not further described below.

The cigarette tube 601 has an elongated cylindrical shape and comprises an inhalation end 608 having a first width or diameter D601, and a lighting end 609 having a second width or diameter D602 that is substantially equal to the first diameter D601. The seam 604 in the shell 602 helicoils 360 degrees around the center line Q of the cigarette tube 601 along the length thereof.

FIG. 6 shows the piano 700 of the cigarette tube 600 according to the second embodiment of the invention. The piano 700 has a circumference that is bound by a first edge 701 that corresponds to the inhalation end 608 of the cigarette tube 600, a second edge 702 opposite to the first edge 101 that corresponds to the lighting end 609 of the cigarette tube 600, a third edge 703 between the first edge 701 and the second edge 702, and a fourth edge 704 between the first edge 701 and the second edge 702 opposite to the third edge 703. The piano 700 furthermore comprises a notional overlap part 705 along the length of the fourth edge 704.

In the piano 700 for the second embodiment the first edge 701 and the second edge 702 of the piano 700 are parallel with respect to each other and the third edge 703 and the fourth edge 704 are parallel with respect to each other. The third edge 703 and the fourth edge 704 are oblique with respect to the first edge 701 and the second edge 702 whereby the second edge 702 is offset with respect to the first edge 701 in a direction transverse to the general longitudinal direction of the piano 700. The offset of the second edge 702 is related to the degrees the seam 604 helicoils around the center line Q of the cigarette tube 600. The more the seam 604 helicoils around the center line Q of the cigarette tube 600, the more the second edge 702 is offset with respect to the first edge 701, and therefore the bigger the angle between the third edge 703 and the fourth edge 704 with respect to first edge 701 and the second edge 702.

In this example the first edge 701 has a first length L601 between the third edge 703 and the overlap part 705 that is related to the first diameter D601 of the inhalation end 608 of the cigarette tube 600 according L601=n*D601.

The second edge 702 has a second length L602 between the third edge 703 and the overlap part 705 that is related to the second diameter D602 of the lighting end 609 of the cigarette tube 601 according L602=n*D602. The second length L602 is substantially equal to the first length L601.

In this example the seam 604 of the cigarette tube 601 that is rolled from the piano 700 helicoils 360 degrees around the center line Q of the cigarette tube 601. Therefore the second edge 702 of the piano 700 is offset over a distance substantially equal to the second length L602 of the second edge 702.

FIG. 7 shows the piano 800 for a cigarette tube according to the third embodiment of the invention. The piano 800 may be used to roll a conical cigarette tube that has a seam that is straight along the shell of the cigarette tube in the direction of the center line Q thereof. The piano 800 is generally the same as the piano 100 of the first embodiment of the invention as described above. Reference numbers of identical parts are increased by 700, and those parts are not further described below.

The piano 800 has an elongated shape and has a circumference that is bound by a first edge 801, a second edge 802 opposite to the first edge 801, a straight longitudinal third edge 803 between the first edge 801 and the second edge 802, and a straight longitudinal fourth edge 804 between the first edge 801 and the second edge 802 opposite to the third edge 803. The piano 800 furthermore comprises a notional overlap part 805 along the length of the fourth edge 804 and a handling lip 806 that protrudes from the fourth edge 804 at the corner between the first edge 801 and the fourth edge 804. In this example the seam of the cigarette tube that is rolled from the piano 800 is straight along the shell of the cigarette tube in the direction of the center line thereof.

To roll a cigarette tube from the piano 800 it is rolled around the center line Q, starting from the corner where the handling lip 806 is located, in this example the corner between the first edge 802 and the fourth edge 804. The handling lip 806 and the fourth 804 edge are brought in overlap with the third edge 803. The handling lip 806 engages the third edge 803 so that, when rolling further, the third edge 803 and fourth edge 804 are brought in overlap with each other to form the seam of the cigarette tube. The rolling method results in a substantially constant overlap distance B of the cigarette paper 5 of less than 3 millimeters, in this example it is equal to 1,5 millimeters. The third edge 803 and the fourth edge 504 are attached to each other by applying adhesive to the overlap part 805. A small section of the shell along the end thereof, that comprises the handling lip 806, may be removed from the cigarette tube in order to obtain a cigarette tube that does not comprise the handling lip 806. The section of the shell along the end thereof may be removed by axially cutting the cigarette tube.

It is to be understood that when the handling lip 506 is located at a different corner of the piano 500 the rolling method of the cigarette tube as described above is started from the corresponding corner.

Figure 8:
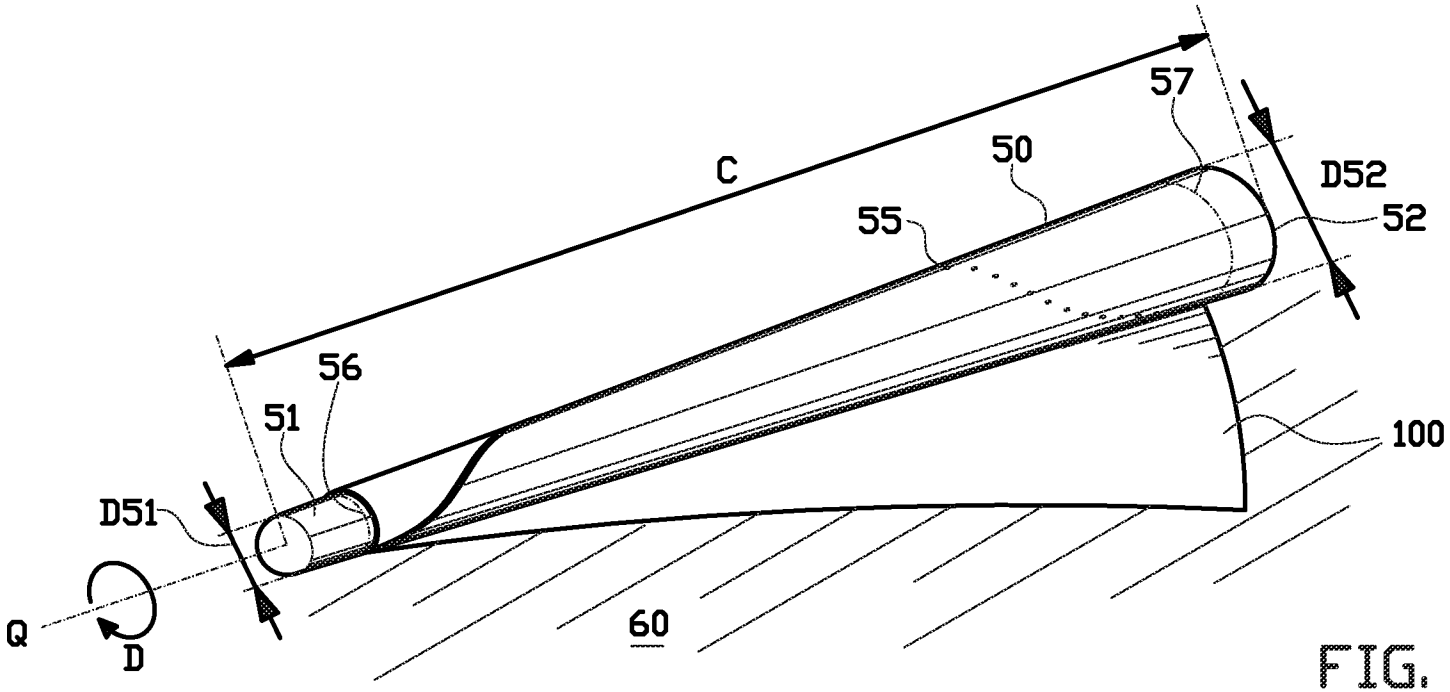
FIG. 8 shows a conical rolling mandrel that may be used to roll a cigarette tube as shown in FIG. 1 from the piano as shown in FIG. 2.

FIG. 8 shows a first rolling mandrel 50 that can be used to roll the cigarette tubes 1 from the piano 100 thereof according to the first embodiment. The rolling mandrel 50 has a longitudinal frustoconical shape that corresponds to the shape of the cigarette tube 1. It is to be understood that the below description of the rolling mandrel 50 is not limited to this specific piano 100 and/or cigarette tube 1 but also applies to any other piano and/or cigarette tube according to the invention.

The rolling mandrel 50 comprises a first mandrel end 51 having a first mandrel width or diameter D51 and a second mandrel end 52 having a second mandrel width or diameter D52 which is larger than the first mandrel diameter D51. The rolling mandrel 50 has a mandrel length C along its center line between the first mandrel end 51 and the second mandrel end 52. In this example the mandrel length C is larger than the tube length A of the cigarette tube 1.

The rolling mandrel 50 furthermore comprises holes 55 on its surface that are in communication with a not shown internal channel of the mandrel 50. The holes 55 are in this example arranged along a line that spirals along the length of the rolling mandrel 50 between the first mandrel end 51 and the second mandrel end 52. The internal channel provides a pressure that is lower than the pressure outside the mandrel 50 in order to induce an airflow through the holes 55 from the environment, via the holes 55, into the internal channel. The airflow provides a suction force on the piano 100 so that the piano sticks to the surface of the rolling mandrel 100.

The rolling mandrel 50 furthermore comprises first alignment indicators or lines 56 and second alignment indicators or lines 57 near the first mandrel end 51 and second mandrel end 52 respectively. The first alignment line 56 and the second alignment line 57 respectively correspond to the first edge 101 and second edge 102 of the piano 100 and can be used to align the rolling mandrel 50 with the piano 100 or vice versa.

To roll the cigarette tube 1 from the piano 100 using the rolling mandrel 50 the piano 100 is placed flat on a surface 60, preferably on a flat surface 60. The rolling mandrel 50 is placed in longitudinal direction next to the third edge 103 of the piano 100. The first alignment line 56 and the second alignment line 57 of the rolling mandrel 50 are aligned with respectively the first edge 101 and the second edge 102 of the piano 100. The rolling mandrel 50 is rolled over the surface 60 in a rolling direction D towards the third edge 103 of the piano 100.

First the rolling mandrel 50 rolls onto the corner between the first edge 101 and the third edge 103. The airflow through the holes 55 on the surface of the mandrel 50 provides a suction force on the piano 100. The piano 100 sticks to the surface of the rolling mandrel 50 and rolls with the rolling mandrel 50. The rolling mandrel 50 is rolled further until the entire piano 100 covers the surface of the rolling mandrel 50. At this point the overlap part 105 of the piano 100 overlaps the piano 100 along the third edge 103 over a substantially constant overlap distance B. The piano 100 is attached to itself by applying adhesive on the overlap part 105 to form the cigarette tube 1. Subsequently the cigarette tube 1 is slided from the rolling mandrel 50 in a direction towards the first mandrel end 51.

It is to be understood that the cigarette tube 1 may be rolled from the piano 100 by rolling the rolling mandrel 50 in the opposite direction and/or by starting rolling at the opposite fourth edge 104 of the piano 100 and/or by starting rolling at a different corner of the piano 100. Furthermore it is to be understood that the above description of the cigarette tube rolling method is not limited to this specific piano 100 and/or cigarette tube 1 but also applies to any other piano and/or cigarette tube 1 according to the invention.

Figure 9:
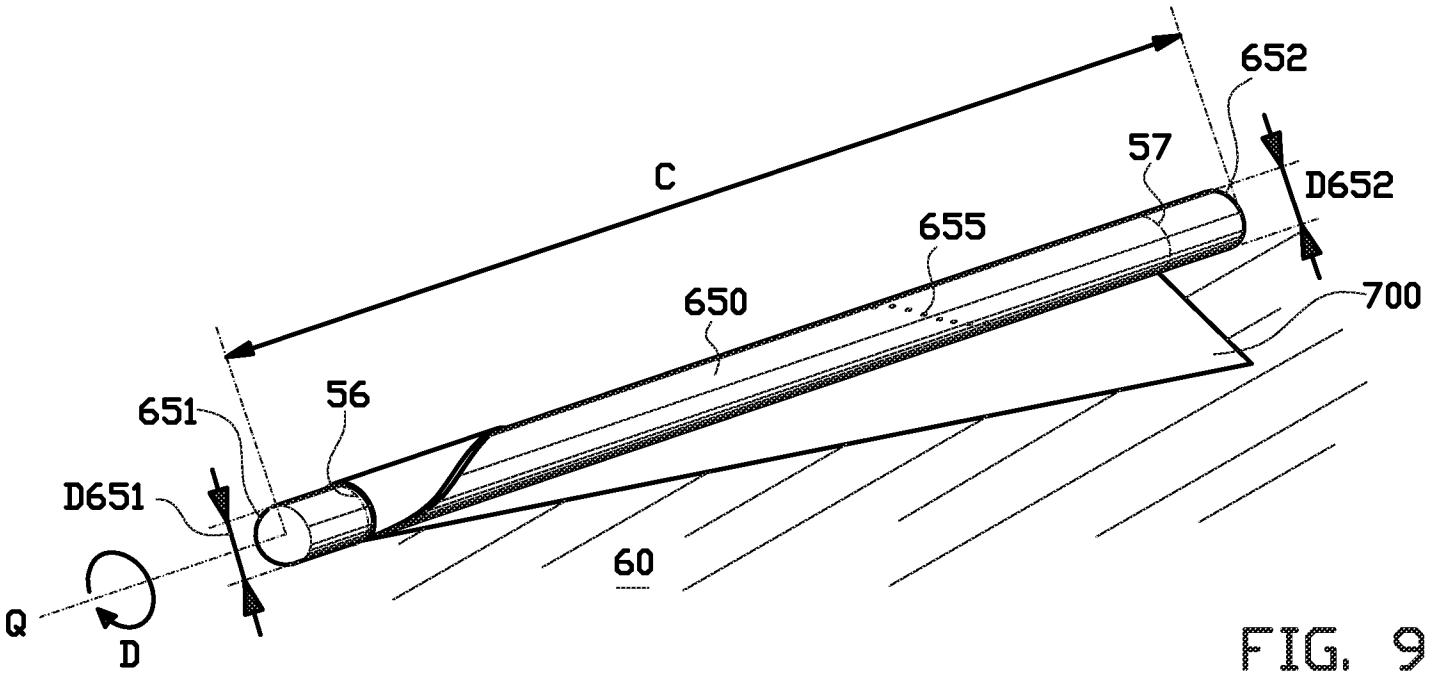
FIG. 9 shows a cylindrical rolling mandrel that may be used to roll a cigarette tube as shown in FIG. 5 from the piano as shown in FIG. 6.

FIG. 9 shows a second rolling mandrel 650 that can be used to roll the cigarette tube 601 from the piano 700 thereof according to the second embodiment. The rolling mandrel 650 has a longitudinal straight cylindrical shape that corresponds to the shape of the cigarette tube 601. The rolling mandrel 650 is generally the same as the rolling mandrel 50 according to the first embodiment as described above. Reference numbers of identical parts are increased by 600. The rolling mandrel 650 is not further described. The cigarette tube rolling method as described above also applies to this rolling mandrel 650.

Figure 10A:
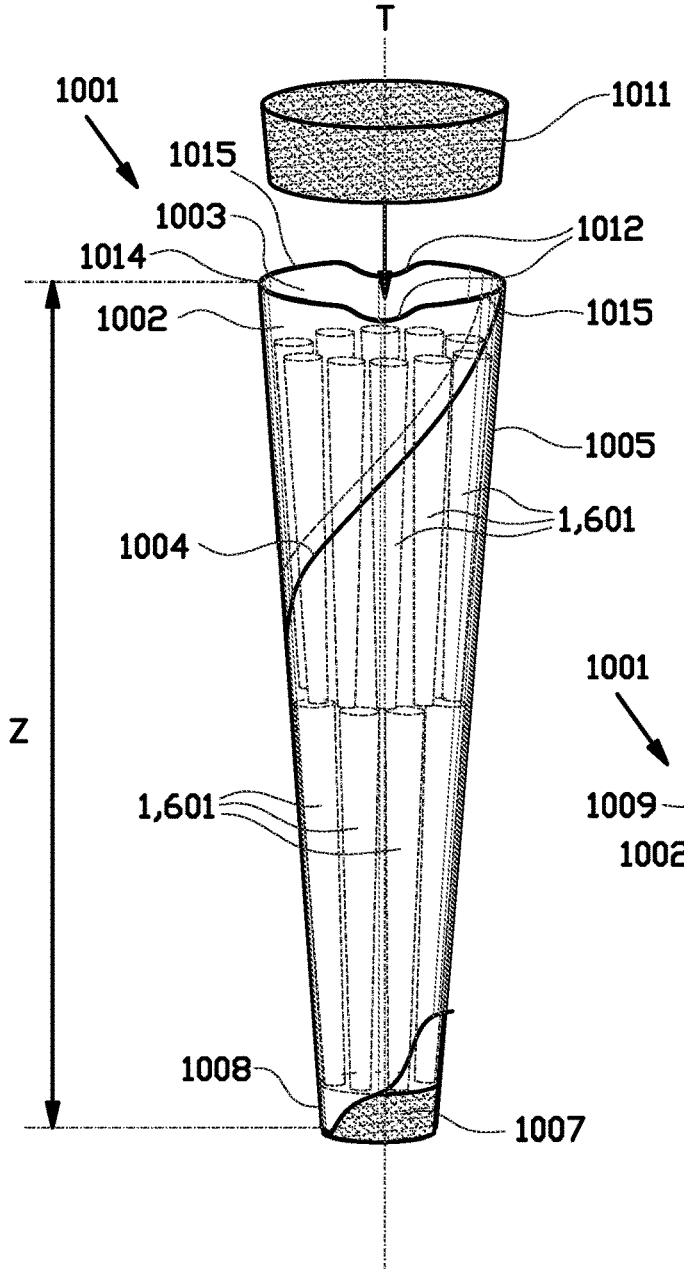
FIGS. 10A and 10B show a conical packaging according to an embodiment of the invention before and after closure, containing multiple of the conical cigarette tubes according to the first embodiment or second embodiment of the invention.
Figure 10B:
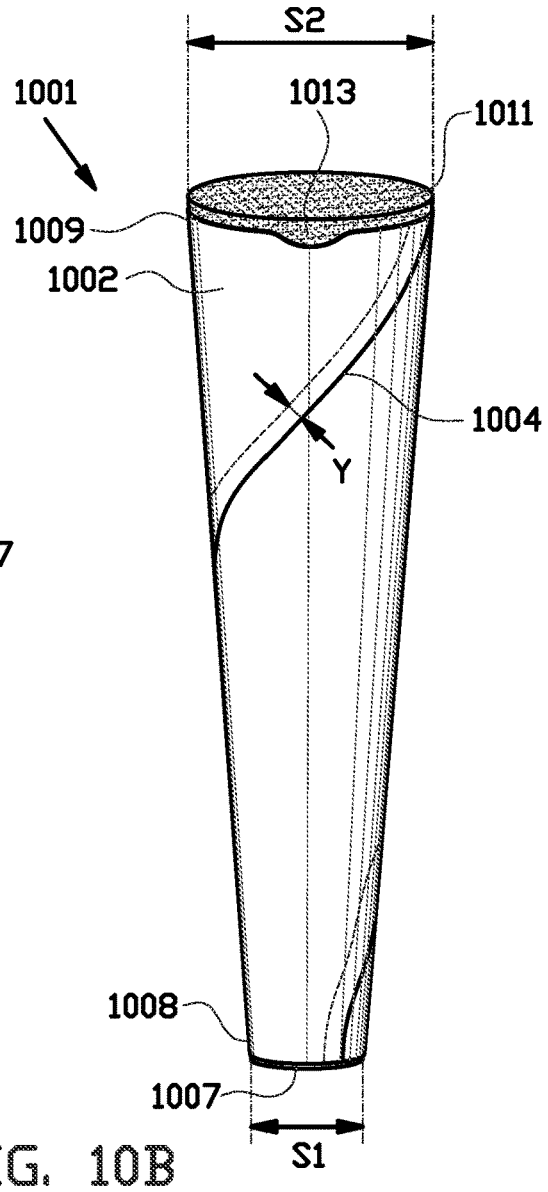

FIGS. 10A and 10B show a packaging 1001 according to an embodiment of the invention. The packaging 1001 comprises a conical shell 1002 that defines an internal channel 1003 with a center line T. The shell 1002 comprises a single sheet of packaging carton or packaging paper 1005 around the center line T. The edges of the packaging paper 1005 only overlap along the length of the packaging 1001, that is, the shell 1002 mostly comprises only one layer of packaging paper 1005 around the center line T. The overlapping edges of the packaging paper 1005 form a spiraled seam 1004 of the shell 1002 having a helicoid curvature around the center line T. Along the seam 1004 the packaging paper 1005 is attached onto itself by a not shown line of an adhesive, more specifically a glue. The packaging 1001 furthermore comprises a permanent bottom closure 1007 and a removable top closure 1011. The closures 1007, 1011 are made of a rigid material or from stable material, such as cork or a plastic, and have an outer shape that complies with the inner channel 1003. The bottom closure 1007 extends fully and tightly inside the shell 1002 and is fixated therein by means of an adhesive. The top closure 1011 extends for its mayor part inside the shell 1002 and is in tight contact therewith to keep the top closure 1011 in place by means of frictional contact. The packaging 1001 contains multiple of the conical cigarette tubes 1, 601 according to the first embodiment or second embodiment of the invention. The cigarette tubes 1, 601 form a stack of one or multiple layers, in this example two layers, each with just enough cigarette tubes 1, 601 to fill out the internal channel 1003 without deformation of the cigarette tubes 1, 601.

The shell 1002 of the packaging 1001 has an elongated frustoconical shape and comprises a bottom end 1008 having a first width or diameter S1, and a top end 1009 having a second width or diameter S2 which is larger than the first diameter S1. The shell 1005 has a length Z along the center line T between the bottom end 1008 and the top end 1009. The top end 1009 is bounded by a circumferential edge 1014 that has one or more straight sections 1015 that extend in a same straight plane transverse to the center line T, and that merge into one or more recessed curved sections 1012 on opposite sides of the center line T. The sides of the top closure 1011 are locally exposed by the curved sections 1011 whereby the top closure can be manually gripped to be taken out.

In this example the seam 1004 helicoils 360 degrees or more around the center line T over the length Z of the shell 1005, that is, the ends of the seam 1004 are located on the same side of the shell 1002 at both the bottom end 1008 and at the top end 1009. A substantially constant overlap distance Y of the packaging paper 1005 in a direction substantially transverse to the seam 1004 is about 5-15 millimeters, in this example it is equal to 10 millimeters.

Figure 11:
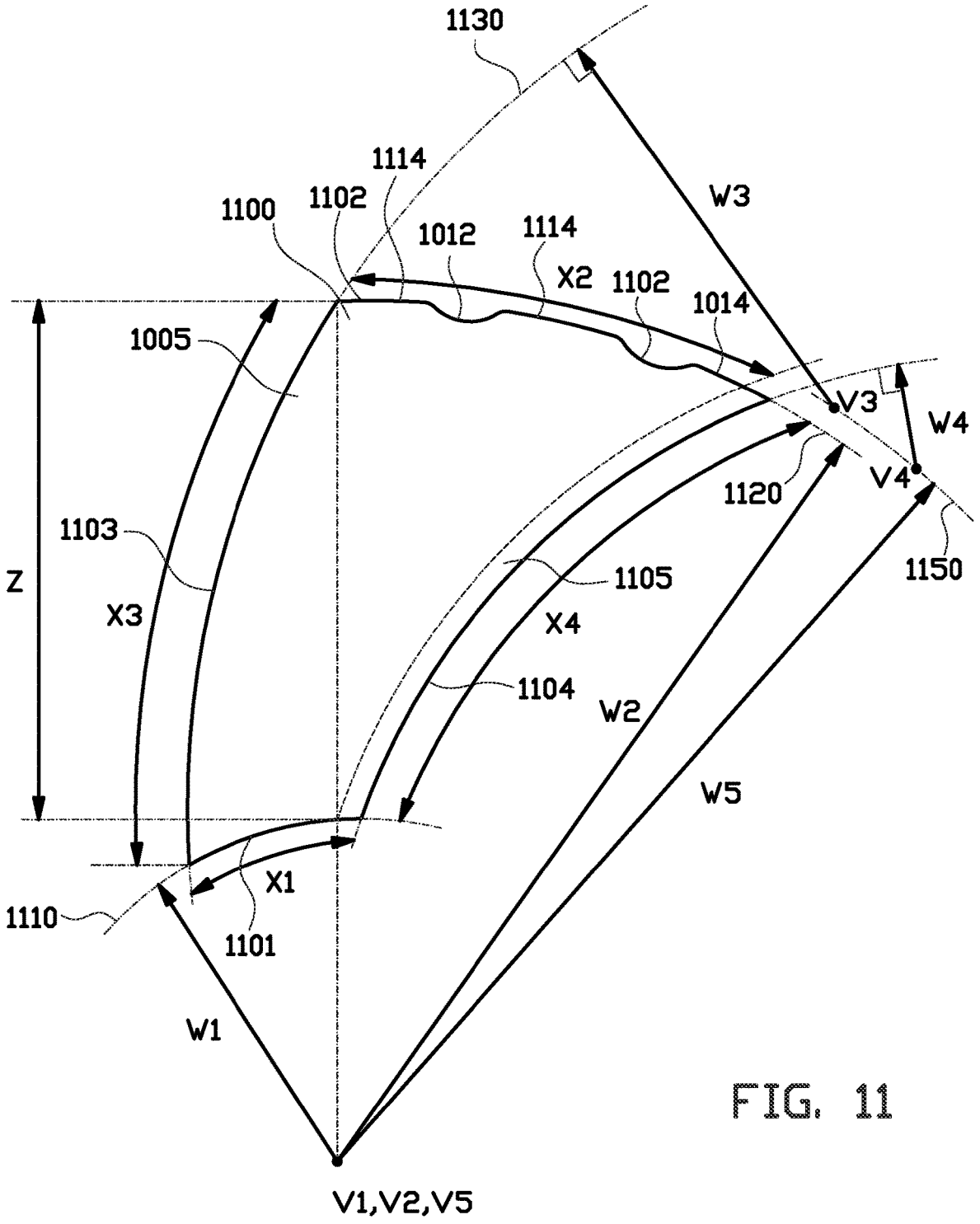
FIG. 11 shows a piano of the packaging of FIGS. 10A and 10B.

FIG. 11 shows a piano 1100 of the packaging paper 1005 as shown in FIGS. 10A and 10B. The piano 1100 can be used to construct or roll the shell 1002 according to the invention as shown in FIGS. 10A and 10B.

The piano 1100 of FIG. 11 has an elongated shape and has a circumference that is bound by a first edge 1101 that corresponds to the bottom end 1008 of the shell 1002, a second edge 1102 opposite to the first edge 1101 that corresponds to the top end 1009 of the shell 1002, a longitudinal third edge 1103 between the first edge 1101 and the second edge 1102, and a longitudinal fourth edge 1104 between the first edge 1101 and the second edge 1102 opposite to the third edge 1103. The piano 1100 furthermore comprises a notional overlap part 1105 along the length of the fourth edge 1104. The overlap part 1105 corresponds to the overlap of the packaging paper 1005 along the seam 1004 of the shell 1002. The overlap part 1105 comprises the line of adhesive along the length of the fourth edge 1104. It is to be understood that the notional overlap part 1105 and the adhesive may also be located in the same way along the opposite third edge 1103 of the piano 1100.

The second edge 1102 is offset with respect to the first edge 1101 in a direction transverse to the general longitudinal direction of the piano 1100. The offset of the second edge 1102 is related to the degree the seam 1004 spirals or helicoils around the center line T of the shell 1002. The more the seam 1004 helicoils around the center line T of the shell 1002, the more the second edge 1102 is offset with respect to the first edge 1101.

In this example the first edge 1101 corresponds to a section of the circumference of a notional first circle 1110 having a first center point V1 and a first radius 1. The second edge 1102 corresponds to a section of the circumference of a notional second circle 1120 having a second center point V2 and a second radius W2. The second center point V2 coincides with the first center point V1. The circumferences of the first circle 1110 and the second circle 1120 are spaced apart over a distance that is equal to the tube length Z.

The first edge 1101 has a first length X1 between the third edge 1103 and the overlap part 1105 along the circumference of the first circle 1110. The first length X1 is related to the first diameter S1 of the bottom end 1008 of the shell 1002 according X1=n*S1.

The second edge 1102 has a second length X2 between the third edge 1103 and the overlap part 1105 along the circumference of the second circle 1120. The second length X2 is related to the second diameter S2 of the top end 1009 of the shell 1002 according X2=n*S2. The second length X2 is larger than the first length X1.

The first diameter S1, the second diameter S2 and the tube length Z are related to the first radius W1 and the second radius W2 according W1=Z/(S2/S1−1) and W2=Z/(1−S1/S2).

In this example the seam 1004 of the shell 1002 that is rolled from the piano 1100 helicoils 360 degrees around the center line T of the shell 1002. Therefore the second edge 1102 is offset over a distance substantially equal to the second length X2 of the second edge 1102 along the circumference of the second circle 1120.

The third edge 1103 corresponds to a section of the circumference of a notional third circle 1130 having a third center point V3 and a third radius W3. The fourth edge 1104 corresponds to a section of the circumference of a notional fourth circle 1140 having a fourth center point V4 and a fourth radius W4 that is equal to the third radius W3. The third radius W3 and the fourth radius W4 are related to the degree the seam 1004 helicoils around the center line T of the shell 1002.

The circumference of the third circle 1130 and the fourth circle 1140 intersect the first center point V1 and the second center point V2. Furthermore the third center point V3 and the fourth center point V4 are both located on the circumference of a notional fifth circle 1150 having a fifth center point V5 and a fifth radius W5. The fifth center point V5 coincides with the first center point V1 and the second center point V2.

The third edge 1103 has a third length X3 along the circumference of the third circle 1130 between the first edge 1101 and the second edge 1102. The fourth edge 1104 has a fourth length X4 along the circumference of the fourth circle 1140 between the first edge 1101 and the second edge 1102.

Figure 12:
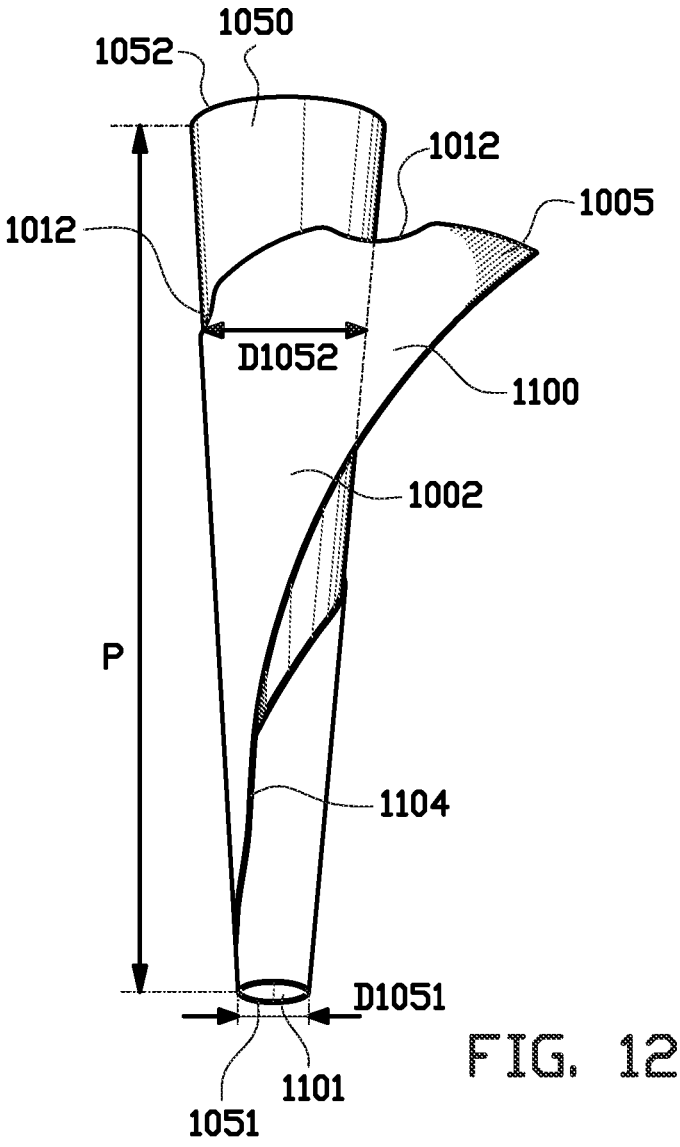
FIG. 12 shows a conical rolling mandrel that may be used to roll the packaging as shown in FIGS. 10A and 10B from the piano as shown in FIG. 11.

FIG. 12 shows a third rolling mandrel 1050 that can be used to roll the shell 1002 from the piano 1100 thereof. The rolling mandrel 1050 has a longitudinal frustoconical shape that corresponds to the shape of the shell 1002.

The rolling mandrel 1050 comprises a first mandrel end 1051 having a first mandrel width or diameter D1051 and a second mandrel end 1052 having a second mandrel width or diameter D1052 which is larger than the first mandrel diameter D1051. The rolling mandrel 1050 has a mandrel length P along its center line between the first mandrel end 1051 and the second mandrel end 1052. In this example the mandrel length P is larger than the tube length Z of the shell 1002.

To roll a shell 1002 from the piano 1100 it is rolled around the center line T, starting from the corner between the second edge 1102 and the fourth edge 1104. When rolling further, the third edge 1103 and fourth edge 1104 are brought in overlap with each other to form the seam of the shell 1002. The third edge 1103 and the fourth edge 1104 are attached to each other by applying adhesive to the overlap part 1105. After rolling, the bottom closure 1007 is inserted from above and glued inside the bottom end 1008. Alternatively the bottom closure 1007 replaces a part of the distal end of the rolling mandrel 1050 whereby the piano 1100 is rolled and glued to the bottom closure 1007 simultaneously.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. Cigarette tube comprising a shell with an inhalation end, a lighting end and an internal channel with a center line, wherein the shell comprises a cigarette paper around the center line, wherein the cigarette paper has, in an unrolled configuration:

a first edge that corresponds to the inhalation end and corresponds to a section of a circumference of a notional first circle having a first center point, a second edge opposite to the first edge that corresponds to the lighting end and corresponds to a section of circumference of a notional second circle having a second center point that coincides with the first center point, a longitudinal curved third edge between the first edge and the second edge, and a longitudinal fourth curved edge between the first edge and the second edge, and wherein the cigarette paper has, when in a rolled configuration, meeting edges that overlap longitudinally and form a seam of the shell to provide overlapping edges, wherein the seam has in the direction of the center line between its opposite ends a helicoid curvature around the center line, and the overlapping edges overlap each other over a distance transverse to the overlapping edges of at least 2 millimeters and no more than 3 millimeters.

2. Cigarette tube according to claim 1, wherein the seam has between its opposite ends a helicoid curvature of at least 90 and no more than 180 degrees.

3. Cigarette tube according to claim 1, wherein the seam extends in the direction of the center line between the inhalation end and the lighting end.

4. Cigarette tube according to claim 1, wherein the shell conically widens from the inhalation end to the lighting end.

5. Cigarette tube according to claim 1, wherein the overlapping edges overlap each other over a distance transverse to the overlapping edges that is constant over the length of the seam.

6. Cigarette tube according to claim 1, wherein the overlapping edges are attached to each other with an adhesive.

7. Cigarette tube according to claim 1, comprising at the inhalation end a filter inside the shell.

8. Cigarette tube according to claim 1, wherein the cigarette paper has a thickness between 10 and 40 micrometers.

9. Cigarette tube according to claim 1, wherein the shell is straight cylindrical from the inhalation end to the lighting end.

10. Cigarette tube according to claim 1, wherein the cigarette paper has a specific weight between 5 and 30 grams per square meter.

11. Cigarette tube according to claim 1, wherein the cigarette paper has a specific weight between 8.5 and 25 grams per square meter.

12. Cigarette tube according to claim 1, wherein the seam has between its opposite ends a helicoid curvature of at least 90 and no more than 360 degrees around the center line.

13. Cigarette tube according to claim 1, wherein the seam has between its opposite ends a helicoid curvature of at least 90 and no more than 540 degrees around the center line.

14. Cigarette tube according to claim 1, wherein the seam has between its opposite ends a helicoid curvature of at least 90 and no more than 720 degrees around the center line.

15. Cigarette tube according to claim 1, wherein the cigarette paper has a thickness between 18 and 30 micrometers.

* * * * *